US009765730B2

(12) United States Patent
Larsson et al.

(10) Patent No.: US 9,765,730 B2
(45) Date of Patent: Sep. 19, 2017

(54) METHOD FOR CONTROLLING THE FUEL SUPPLY TO AN INTERNAL COMBUSTION ENGINE AT START-UP AND A CARBURETOR

(75) Inventors: Mikael Larsson, Jönköping (SE); Magnus Ottosson, Norrahammar (SE); Bo Carlsson, Alingsås (SE)

(73) Assignee: HUSQVARNA AB, Huskvarna (SE)

( * ) Notice: Subject to any disclaimer, the term of this patent is extended or adjusted under 35 U.S.C. 154(b) by 1022 days.

(21) Appl. No.: 13/806,244

(22) PCT Filed: Jun. 28, 2011

(86) PCT No.: PCT/SE2011/050851

§ 371 (c)(1),
(2), (4) Date: Dec. 21, 2012

(87) PCT Pub. No.: WO2012/002888

PCT Pub. Date: Jan. 5, 2012

(65) Prior Publication Data

US 2013/0133618 A1 May 30, 2013

(30) Foreign Application Priority Data

Jul. 1, 2010 (WO) ..... PCT/SE2010/050758

(51) Int. Cl.
*F02M 1/08* (2006.01)
*F02D 41/06* (2006.01)
(Continued)

(52) U.S. Cl.
CPC ..... *F02M 1/08* (2013.01); *F02D 41/065* (2013.01); *F02M 17/04* (2013.01); *F02D 41/047* (2013.01);
(Continued)

(58) Field of Classification Search
CPC .. F02M 1/02; F02M 1/16; F02M 1/08; F02M 7/133; F02M 2700/126; F01M 1/00
See application file for complete search history.

(56) References Cited

U.S. PATENT DOCUMENTS 2,120,970 A 6/1938 Allen
2,571,181 A * 10/1951 Ball ..... F02M 1/10 123/179.15

(Continued)

OTHER PUBLICATIONS

Hehnke, et al., "Intelligent Engine Management System for Small Handheld Low Emission Engines," 2009.

(Continued)

*Primary Examiner* — Erick Solis
*Assistant Examiner* — Anthony L Bacon
(74) *Attorney, Agent, or Firm* — McNair Law Firm, P.A.

(57) ABSTRACT

The invention concerns a method for controlling the fuel supply to an internal combustion engine at start-up, the engine having a fuel supply system. The invention also concerns a carburetor having a fuel supply system including a main fuel path connecting a diaphragm controlled regulating chamber to a main outlet in the region of the venturi section, the main fuel path including an actively controlled fuel valve, and an idling fuel path branching off from the main fuel path downstream of the valve and ending in at least one idling outlet in the region of a throttle valve, the fuel supply system further including a start fuel line starting upstream or downstream of the fuel valve and ending in at least one start fuel outlet to the intake channel.

20 Claims, 4 Drawing Sheets

(51) Int. Cl.
*F02M 17/04* (2006.01)
*F02D 41/04* (2006.01)

(52) U.S. Cl.
CPC ..... *F02D 2400/02* (2013.01); *F02D 2400/04* (2013.01)

(56) References Cited

U.S. PATENT DOCUMENTS 4,018,856 A * 4/1977 Hamakawa ..... F02M 7/087 123/179.15
4,723,523 A 2/1988 Kataoka et al.
4,770,823 A * 9/1988 Sejimo ..... B60B 7/0086 236/101 E
4,986,229 A 1/1991 Suzuki et al.
5,611,312 A * 3/1997 Swanson ..... F02M 1/02 123/179.18
5,794,593 A 8/1998 Sugii
5,852,998 A 12/1998 Yoshioka
6,135,428 A 10/2000 Schliemann et al.
6,273,065 B1 * 8/2001 Carpenter ..... F02D 35/003 123/436
6,848,405 B1 2/2005 Dow et al.
6,880,812 B2 4/2005 Nonaka
6,932,058 B2 8/2005 Nickel et al.
7,603,983 B2 10/2009 Bähner et al.
2003/0010297 A1 * 1/2003 Strom ..... F02M 1/16 123/73 A
2005/0022790 A1 2/2005 Nickel et al.
2005/0098907 A1 * 5/2005 Richard ..... F02D 41/064 261/39.1
2007/0034180 A1 * 2/2007 Naegele ..... F02B 25/22 123/73 A
2009/0013951 A1 1/2009 Nakata et al.
2009/0013965 A1 1/2009 Bahner et al.
2010/0320625 A1 * 12/2010 Fujii ..... F02M 1/046 261/34.1
2011/0068487 A1 3/2011 Naegele et al.

OTHER PUBLICATIONS

International Search Report and Written Opinion of PCT/SE2010/050758 mailed May 10, 2011.
Chapter I International Preliminary Report on Patentability of PCT/SE2010/050758 mailed Jan. 8, 2013.
International Search Report and Written Opinion of PCT/SE2011/050851 mailed Nov. 16, 2011.
Chapter I International Preliminary Report on Patentability of PCT/SE2011/050851 mailed Jan. 8, 2013.

* cited by examiner

Figure 1
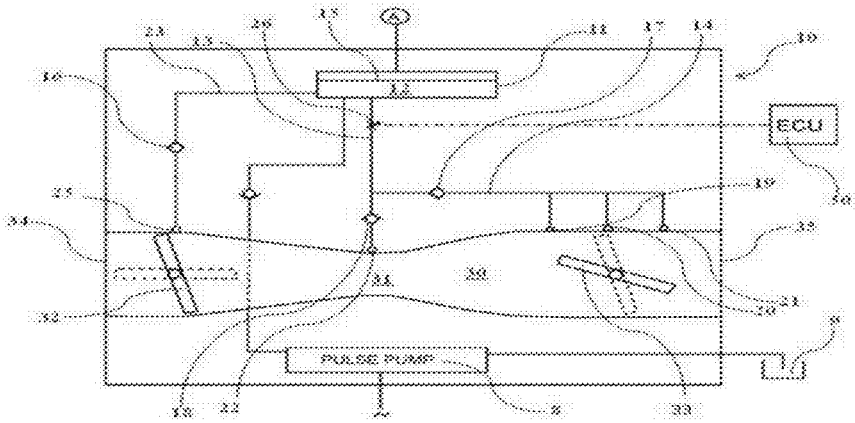
Figure 1A
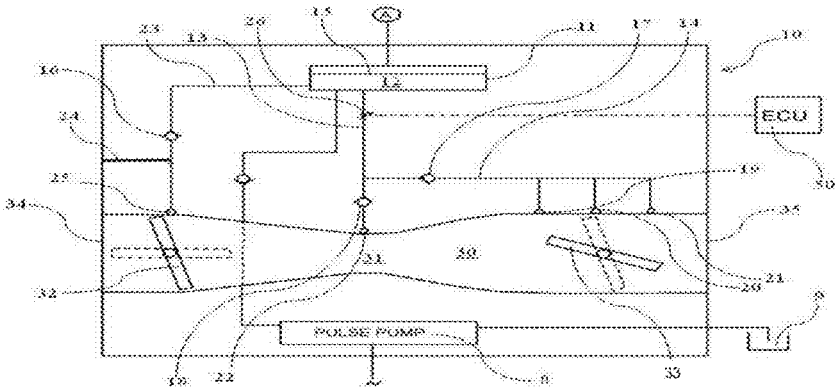
Figure 1B

METHOD FOR CONTROLLING THE FUEL SUPPLY TO AN INTERNAL COMBUSTION ENGINE AT START-UP AND A CARBURETOR

TECHNICAL FIELD

The invention concerns a method of controlling the fuel supply to an internal combustion engine at start-up, the engine having a fuel supply system.

The invention also concerns a carburetor having an intake channel with a venturi section, a throttle valve mounted in the intake channel downstream of the venturi section, a choke valve mounted in the intake channel upstream of the venturi section, and a fuel supply system including a main fuel path connecting a diaphragm controlled regulating chamber to a main outlet in the region of the venturi section, the main fuel path including an actively controlled fuel valve, and an idling fuel path branching off from the main fuel path downstream of the valve and ending in at least one idling outlet in the region of the throttle valve.

BACKGROUND

Internal combustion engines of two-stroke or four-stroke type usually are equipped with a fuel supply system of carburetor type or injection type. In a carburetor, the throttle of the carburetor is affected by the operator's demand, so that a wide open throttle produces a minimum throttling in the carburetor barrel. The depression created by the passing air in the carburetor venturi draws fuel into the engine.

Diaphragm-type carburetors are particularly useful for hand held engine applications wherein the engine may be operated in substantially any orientation, including upside down. Such carburetors typically include a fuel pump that draws fuel from a fuel tank and feeds the fuel to a fuel pressure regulator via a needle valve. The fuel pressure regulator usually includes a fuel metering chamber that stores fuel fed from the fuel pump and the fuel metering chamber is generally separated from atmosphere by a diaphragm that adjusts the fuel pressure to a constant pressure. The needle valve opens and closes the fuel passage from the fuel pump to the fuel metering chamber as the diaphragm moves. From the fuel metering chamber fuel is delivered to the main air passage via a main channel and an idle channel. The main channel leads to a main nozzle in the main air passage fluidly prior to the throttle valve, whereas the idle channel leads to an idle nozzle fluidly shortly after the throttle valve.

When starting a crankcase-scavenged engine having a conventional carburetor, the choke valve is closed by the operator using a choke button and the throttle valve is set in a start gas position. When pulling the pulling cord to start the engine, an air and fuel mixture is delivered to the crankcase of the engine. When a first ignition is heard by the operator, the choke valve is opened so not to flood the engine with too much fuel. However, sometimes the operator misses the first ignition and the engine is flooded and the product cannot be started as desired.

U.S. Pat. No. 6,932,058 discloses a carburetor including a fuel supply system for supplying fuel from a diaphragm controlled regulating chamber to the intake channel of the carburetor. The fuel supply system includes a main fuel path having a control valve and an idling fuel path that branches off from the main fuel path downstream of the control valve. The control valve thereby controls all fuel supplied to the intake channel. It has however been found out that this solution provides an inadequate fuel supply in certain situations. In particular it is difficult to control the fuel supply at start up.

U.S. Pat. No. 7,603,983 shows a carburetor including a fuel supply system having two independent fuel paths for supplying fuel from a diaphragm controlled regulating chamber to the intake channel of the carburetor. The first fuel path includes a main fuel path having a control valve and an idling fuel path that branches off from the main fuel path downstream of the control valve. A first bypass line bypasses the control valve. The second fuel path connects the regulating chamber to an outlet in the region of the throttle valve and provides a second bypass line. A second valve is mounted in the second bypass line or alternatively in the first start fuel line. The opening and closing of the second valve is controlled by the position of the choke valve. The carburetor further includes an accelerator pump for supplying additional fuel to the main fuel path downstream of the control valve during acceleration. This solution improves the operational range of the fuel supply. It is however costly and includes several additional components compared to e.g. U.S. Pat. No. 6,932,058.

U.S. Pat. No. 6,880,812 discloses a carburetor having two independent fuel supply systems, each including an electromagnetically driven control valve. A control system controls the opening and closing of the valves by using input from an engine speed sensor and a temperature sensor. Also this solution is costly and complex.

US 2009/0013951 shows a carburetor including a fuel supply system having two fuel paths for supplying fuel from a diaphragm controlled regulating to the intake channel of the carburetor. A main path supplies fuel to the intake channel during normal operations. A startup fuel supply passage has a solenoid valve to control the timing of startup fuel delivery. In this carburetor the fuel supply cannot be electronically controlled during normal operations since the solenoid valve only operates on the startup fuel supply passage. This is inadequate.

OBJECT OF THE INVENTION

One object of the invention is to provide a method of controlling the fuel supply when attempting to start a crankcase-scavenged engine.

Another object is to provide a carburetor for controlling the fuel supply when attempting to start a crankcase-scavenged engine so as to reduce the risk of flooding the engine at start up while being capable of delivering extra fuel during a start attempt.

SUMMARY OF THE INVENTION

At least one of these objects or problems mentioned above is addressed by a method of controlling the fuel supply to an internal combustion engine at start-up, the engine having a fuel supply system which can be set in at least two start modes, a lean mode, and a rich mode, the rich mode providing extra fuel during start-up of the engine, the method including:

a) during a start attempt, determining if the next start attempt should be executed in lean or rich mode based on an evaluation of at least one engine parameter/s from the previous start attempt and/or at least one engine parameter/s from the last successful run, and/or at least one engine parameters/s of the present start attempt; and b) setting the fuel supply system in rich or lean mode depending of the evaluation in such way that the next start attempt is executed in said rich or lean mode. Thereby the fuel supply at start up can be optimized.

Preferably, the fuel supply system is set in lean mode when the engine is stopped after a successful run so that a first start attempt is always executed in lean mode. Thereby the risk of flooding then engine at start up is reduced.

Preferably, a start attempt is determined in that the engine is started when set in a start position, and that the method includes the step of detecting that the engine is started in the start position, and where preferably the start position is having a throttle valve in a start gas position, e.g. having a throttle ratio in the interval 5-20, 20-40, 40-60, or 60-90%, for example, and a choke valve in closed position.

Preferably, in step a) the evaluation includes determining an ignition indication has occurred in the present start attempt based on at least one monitored engine parameter/s of the present start attempt, and wherein if an ignition indication is determined to have occurred, in step b) the fuel supply system is set or maintained in lean mode.

Preferably, the ignition indication is determined by monitoring the engine speed and evaluating the engine speed behavior during said start attempt, for instance a sudden increase in engine speed could indicate an ignition.

Preferably, the ignition indication is determined if an ignition quotient is larger than a predetermined ignition threshold value, the ignition quotient based on the quotient between the time from the lower dead point to upper dead point and the time from the upper dead point to the lower dead point.

Preferably, the engine parameter/s includes at least one of:

a stop time t2 indicating the time has passed since the last successful run, a run time t1 indicating the duration of the last successful run, a stop temperature T1 of the last engine stop, a start temperature T2 of the present start attempt.

Preferably, the fuel supply system includes a main fuel path connecting a diaphragm controlled regulating chamber to a main outlet in the region of the venturi section, the main fuel path including an electronically controlled valve, and an idling fuel path branching off from the main fuel path downstream of the valve and ending in at least one idling outlet in the region of the throttle valve, the fuel supply system further including a start fuel line starting upstream or downstream of the valve and ending in at least one start fuel outlet to the intake channel.

In this context, the term "start fuel line" is used to designate a fuel line for supplying the additional amount of fuel that usually is required for starting a cold engine.

Preferably, the fuel valve is a bistable two position valve, having an open, first position and a closed, second position and being closed in lean mode and open in rich mode.

Suitably, at least said one start fuel outlet is located upstream of the venturi section, preferably in the region of the choke valve and downstream of it, for supplying fuel to the intake channel.

Preferably, the engine is a crankcase-scavenged engine.

Preferably, the engine is a two-stroke engine. However the engine may also be a four-stroke engine.

The invention also concerns the carburetor mentioned initially, wherein the fuel supply system has only one actively controlled valve, which is located between the regulating chamber and the intake channel and is actively controlled during operation of the engine, and in that the fuel supply system further includes a start fuel line starting upstream or downstream of the valve and ending in at least one start fuel outlet to the intake channel. Thereby a simple and robust fuel supply system can be achieved, still being able to have an adaptive fuel supply at start up.

In one preferred embodiment, the start fuel line starts upstream of the valve and the carburetor includes an air channel that connects ambient air to the start fuel line so that it can draw fuel from the regulating chamber and air from the air channel, thereby diluting the fuel concentration supplied from the start fuel outlet to the intake channel during operation of the engine.

In another preferred embodiment, the start fuel line starts downstream of the valve and the carburetor includes an air conduit that permits a leakage of air past the choke valve, so that it can draw fuel from the main fuel path and air through the conduit past the choke valve, thereby diluting the fuel concentration supplied from the start fuel outlet to the intake channel during operation of the engine.

Preferably, the choke valve is a butterfly valve having a closing mechanism in form of a disk, and wherein the air conduit, which permits a leakage of air past the choke valve, is either an enlarged bore through the disk or an additional bore through the disk to increase the air flow through the choke valve when the valve is closed.

Preferably, the actively controlled valve is a bistable two position valve, having an open, first position and a closed, second position.

Preferably, the actively controlled valve is electronically controlled.

Preferably, said at least one start fuel outlet is located upstream of the venturi section, preferably in the region of the choke valve and downstream of it, for supplying fuel to the intake channel.

BRIEF DESCRIPTION OF THE DRAWINGS

FIG. 1, is defined by FIG. 1A and FIG. 1B, is a schematic drawing of a first embodiment of a fuel supply system of a carburetor.

DESCRIPTION OF THE INVENTION

Figure 2:
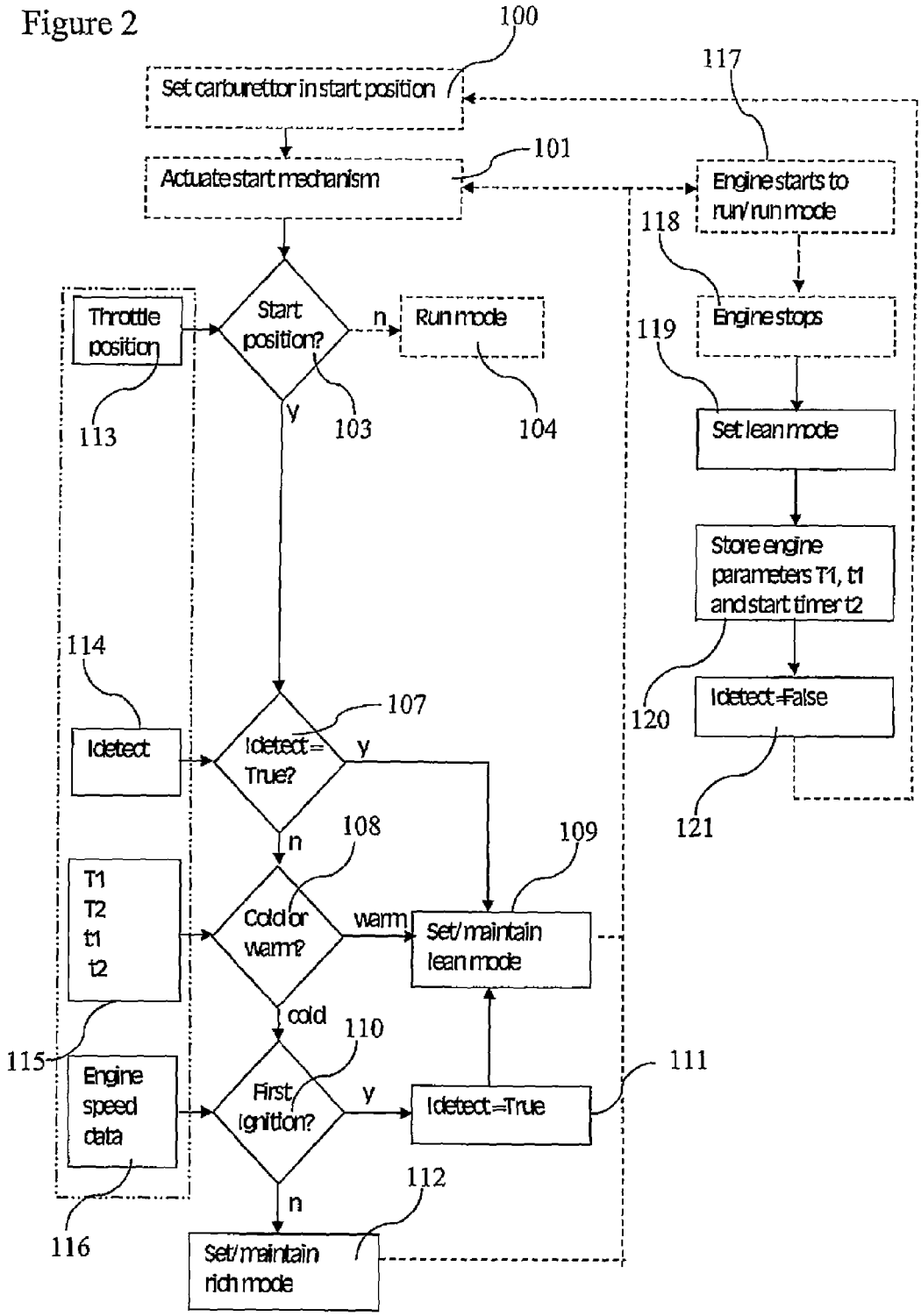
FIG. 2 is a flow chart representing a process for controlling the fuel supply at start up.

The present invention primarily concerns crankcase scavenged, spark ignited, two- or four-stroke engines and any general reference to engines in the following description concerns these type of engines, although also non-crankcase-scavenged engines are possible.

FIG. 1 is a schematic view showing a fuel supply unit in the form of a diaphragm carburetor. The carburetor main body 10 has an intake channel 30 extending from an air inlet side 34 to an air outlet side 35. A choke valve 32 is mounted in the intake channel 30, at the air inlet side 34 thereof, and a throttle valve 33 is mounted in the intake channel 30 at the air outlet side 35 thereof. In-between the throttle valve 33 and the choke valve 32, a venturi 31 is formed in the intake channel 30. During operation, air is drawn from the air inlet side 34 via an air filter (not shown), and an air/fuel mixture is delivered to the engine (not shown) connected to the air outlet side 35.

A fuel pump 8 draws fuel from a fuel tank 9. The fuel pump 8 may be a known pulsation controlled diaphragm pump, driven by the pressure pulse generated by a crankcase of the engine that the carburetor is supplying air and fuel mixture to. The fuel pump 8 delivers fuel, via a needle valve (not shown), to a fuel metering chamber 12 of a fuel regulator 11. The fuel metering chamber 12 is separated from atmospheric pressure by a diaphragm 15 and can hold a predetermined amount of fuel.

A main fuel path 13 connects the fuel metering chamber 12 to a main outlet 22 in the intake channel 30, located in the region of the venturi 31. An actively controlled fuel valve 26 is mounted in the main fuel path 13. The actively controlled fuel valve 26 is preferably a bistable valve that can switch between an open and closed position.

Downstream of the electronically controlled fuel valve 26, an idling fuel path 14 branches off from the main fuel path 13. The idling fuel path 14 itself branches off into three idling outlets 19, 20, 21 to the intake channel 30, which are successively disposed in the region of the throttle valve 33. More precisely, the first idling outlet 19 is disposed upstream of the throttle valve 33 when the latter is closed, the second idling outlet 20 is disposed approximately in the region of a closed throttle valve 33, and the third idling outlet 21 is disposed downstream of the throttle valve 33.

The fuel valve 26 is controlled by an electronic control unit (ECU) 50 that receives sensor inputs, such as throttle position, from at least one throttle position sensor, engine speed from at least one engine speed sensor, and temperature from at least one temperature sensor. The electronic control unit 50 can e.g. use these sensor inputs to decide when to open or close the fuel valve 26.

A start fuel line 23 emanates from the fuel metering chamber 12 and has a start fuel outlet 25 in the region of the choke valve 32, downstream of it. An optional air channel 24, which is shown in FIG. 1B, connects ambient air to the start fuel line 23. The optional air channel 24 is omitted from FIG. 1A. The air channel 24 is for diluting the fuel concentration supplied by the start fuel line 23 to the intake channel 30 during operation of the engine, i.e. by mixing air to fuel drawn by the start fuel outlet 25 due to the pressure variations in the intake channel 30. The start fuel line 23 is preferably made by drilling a narrow bore in the carburetor body from the fuel metering chamber 12 to the intake channel 30. An alternative to the air channel 24 is to reduce the diameter of the bore providing the start fuel line 23, or to add other flow restriction means in the start fuel line 23. The start fuel line 23 could alternatively branch off from the main fuel path 13 upstream of the electronically controlled valve 26.

The main fuel path 13, the idling fuel path 14, and the start fuel line 23 each have a check valve 16-18 for preventing fuel flowing back to the fuel metering chamber 12.

The carburetor 10 can be set in a start position, as e.g. described in U.S. Pat. No. 7,611,131. In the start position, the choke valve 32 is closed, and the throttle valve 33 is slightly open (around 5-20, 20-40, 40-60, or 60-90%, of a fully opened position). When pulling a pull cord to start the engine while the carburetor 10 is in the start position, pressure variations in the intake channel 30 will draw fuel from the start fuel outlet 25. For those revolutions, the electronically controlled valve 26 is open, consequently fuel will be drawn from the main fuel outlet 22 as well as from the idling fuel outlets 19, 20, 21, thereby delivering an additional amount of fuel. However, for those revolutions the fuel valve 26 is closed, fuel will be drawn only from the start fuel outlet 25.

In one preferred embodiment of the invention, the fuel valve 26 is either closed or open for all revolutions during a start attempt (for other operating conditions the fuel valve 26 will open and close frequently to adjust the fuel ratio). In the mode when the fuel valve 26 is closed at the start attempt, the fuel supply system is referred to as being in lean mode, and when the fuel valve is open the fuel supply system is referred to as being in rich mode.

Moving from the start position, the choke valve 32 is released to a fully opened while the throttle valve 33 can take any position between closed (idle throttle) and fully open (maximum throttle). When the throttle valve 33 is closed, fuel will mainly be taken from the first idling outlet 19, and the electronically controlled valve 26 can control the fuel supply during idling by closing and opening the valve 26 according to an idling control scheme as e.g. described in WO 2009/038503, herewith incorporated by reference. In the same manner the fuel supply can be controlled by closing and opening the valve 26 to adjust the air fuel ratio of the as described in e.g. WO 2007/133125 and WO 2007/133148, herewith incorporated by reference.

Controlling the Fuel Supply to an Internal Combustion Engine at Start-Up

A method for controlling the fuel supply to an internal combustion engine at start-up will now be described in more detailed with reference to FIG. 2.

The phantom lined box "Set carburetor in start position" 100 indicates that the operator sets the carburetor in a start position, e.g. closed choke valve 32 and slightly opened throttle valve 33. Thereafter the operator actuates the start mechanism at box 101, e.g. pulls the pulling cord, which box 101 is also drawn with phantom lines indicating that these steps do not form part of the method of the invention.

After actuating the start mechanism, the engine control unit is energized and determines in box "Start position?" 103 whether the carburetor is set in its start position, here, by using a throttle position from a throttle position sensor 113. If the carburetor is not in its start position, the fuel supply system is controlled by other controls methods as indicated by the box "Run mode" 104.

On the other hand, if the start position is detected, the next box "Idetect=True?" 107 checks whether a first ignition was detected in a previous start attempt, by receiving input from box "idetect" 114, i.e. a value symbolizing "True" or "False". If the value is "True" the fuel supply system will be set or maintained in lean mode in box "set/maintain lean mode" 109. On the other hand, if it is "False", the box "Cold or warm?" 108 follows, where it is determined whether the engine is considered to be started warm or cold.

In box 108, the decision of warm or cold is determined by using the engine parameters from box 115, which here represents parameters from the present start attempt and/or from the previous start attempt and/or last successful run. For instance, engine parameters such as a stop temperature T1 stored when the engine was stopped at the last successful run, a start temperature T2 of the present start attempt, and a duration t1 of the last successful run, and a time t2 since the last successful run. As an example, the conditions in box 108 could be:

1) t2>stop time threshold (e.g. 5 minutes)=>cold start, else warm start,
2) t1<duration threshold (e.g. 5 seconds) AND T2<cold temperature threshold (e.g. −5° C.)=>cold start, else warm start,
3) t2>f(T1)=>cold start, else warm start, where $f(T1_1)>f(T1_2)$ if $T1_1>T1_2$.

The first example being the simplest one; if the engine hasn't been running recently, the engine is considered to be cold or else warm. In the second example, the engine is considered to be cold if the last engines run was short and if the temperature sensor indicates that it is very cold, e.g. when the engine is cooled during a cold winter day. In the third example, the time t2 since the last successful run is compared to a value that is dependent of the engine temperature T1 when the engine was stopped, i.e. if the engine is very hot when stopped it will take longer timer for it to cool. The specific conditions are shown as examples, of course more complex conditions could be used, for instance by combining one or more of the examples.

If the engine during the start attempt is determined to have been started warm, the fuel supply system is set or maintained in lean mode in box "Set/maintain lean mode" 109. If the engine is determined to have been started cold, the box "First ignition?" 110 follows.

At the box "First ignition?" 110, a function evaluates engine speed data 116 to detect whether any ignition has occurred during the start attempt. If an ignition is determined to have occurred, the variable "idetect" is set to be "True" in box "Idetect=True" 111. Thereafter, the fuel supply system is set in lean mode at box "Set/maintain lean mode" 109, so that the next start attempt will be performed in lean mode. This is done, since if a first ignition has been determined to have occurred, the engine should be close to starting and having a fuel ratio in the crankcase close to the optimal. Therefore, by setting the fuel supply system in lean mode, the risk of flooding the engine during the next start attempt is minimized.

On the other hand, if no ignition was detected in box 110, the fuel supply system is set or maintained in rich mode at box "Set/maintain rich mode" 112. Thereby, the next start attempt is performed with the fuel supply system in rich mode.

Of course, when the engine starts to run as indicated by the phantom lined box "Engine starts to run" 117, there will be no next start attempt, and other control schemes are activated to govern the fuel supply to the engine.

After a successful run of the engine and the engine is stopped as indicated by the phantom lined box 118, the fuel supply system is set in lean mode at box 119. Furthermore, during shut down, as indicated by box 120, engine parameters such as engine stop temperature T1 and the duration t1 of the successful run are stored, and a timer t2 is started. Also the variable "idetect" is set to "False" during shut down, as indicated by box 121. Thus, after a successful run, the engine will be started with a fuel supply system in lean mode and with the ignition detection set to "False".

Figure 3:
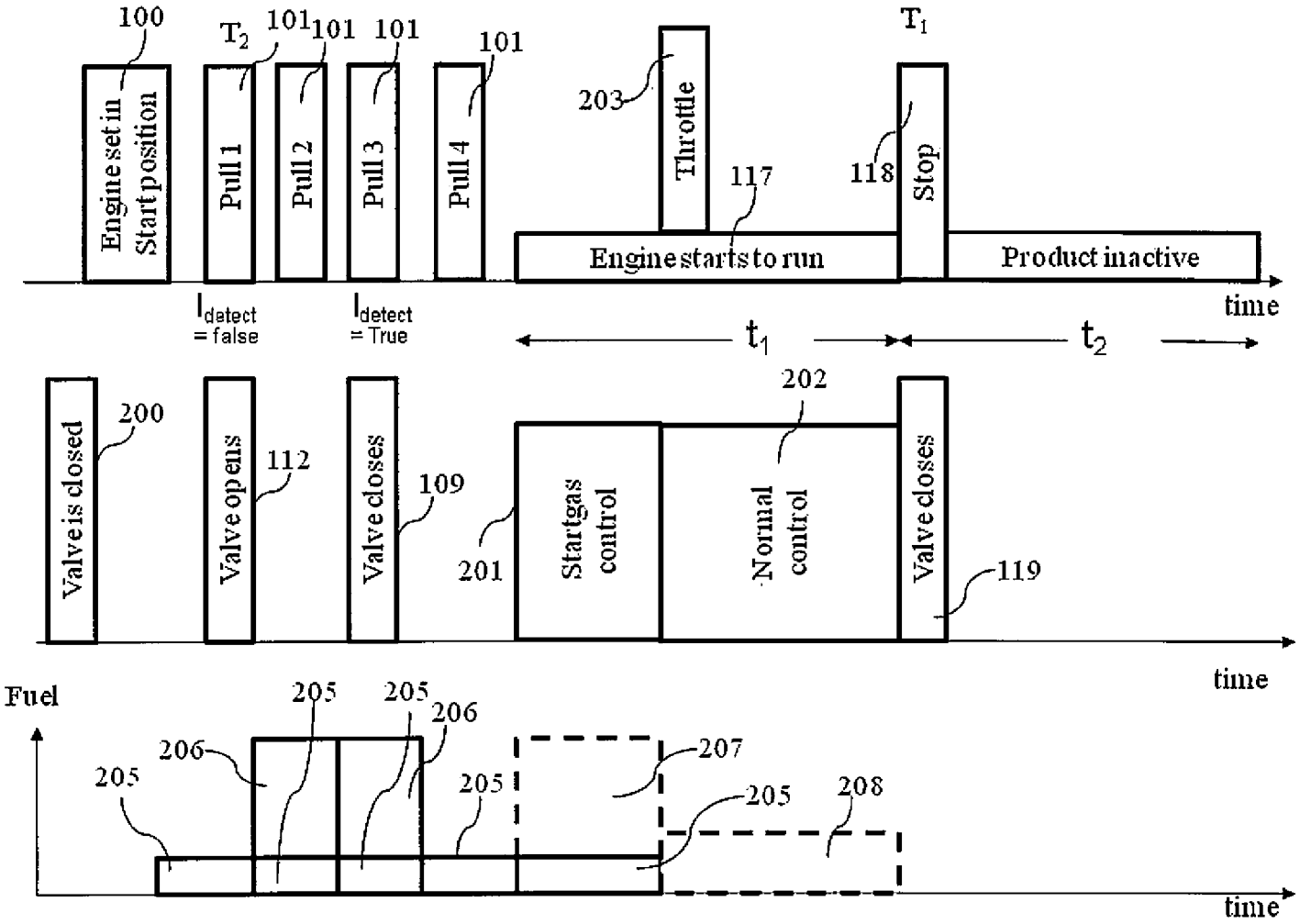
FIG. 3 shows an example of a start attempt.

FIG. 3 shows an example for a start procedure. The upper graph shows operator actions, the middle graph shows fuel valve actions, and the lower graph shows fuel supply, and each graph follows the same time scale. When applicable reference numbers that corresponds to boxes in the control scheme of FIG. 2 have been used, these reference numbers are in the one hundreds. As indicated by reference number 200, the fuel valve 26 (see FIG. 1) is closed (the fuel supply system is in lean mode) before attempting to start the engine. Also before starting, the engine is set in start position by the operator, corresponding to box "Set carburetor in start position" 100 of FIG. 2. After having set the engine in its start position, the operator makes his first start attempt "Pull 1" by pulling the cord, corresponding to box "Actuate start mechanism" 101 of FIG. 2. Since the fuel valve 26 (see FIG. 1) is closed, only a small amount of start fuel 205 from the start fuel outlet 25 (see FIG. 1) is delivered. I.e., this first start attempt is performed in lean mode. During this start attempt, the control scheme of FIG. 2 evaluates if the next start attempt should be executed in lean or rich mode. Here the decision arrived at was that the next start attempt should be executed in rich mode and therefore the fuel valve 26 is opened, corresponding to the box "Set maintain rich mode" 112 of FIG. 2. In the second start attempt "Pull 2", the fuel valve 26 is now open. Hence, in addition to the fuel drawn from the start fuel outlet 25, fuel is also drawn from the main and idling outlets 19-22, thereby providing extra start fuel 206 to the engine. Also during the second start attempt, the control scheme of FIG. 2 is run to evaluate whether the next start attempt should be executed in lean or rich mode. Here the decision arrived at was that the next start attempt should continue to be executed in rich mode, and hence the fuel valve 26 remained open. In the third start attempt "Pull 3", the fuel valve 26 is open, and fuel is therefore drawn from the start fuel outlet 25, and the main and idling outlets 19-22, thereby providing extra start fuel 206 to the engine. As was done during the first and the second start attempt, the control scheme of FIG. 2 was run to evaluate if the next start attempt should be executed in lean or rich mode. Here, a first ignition was detected, and therefore the fuel supply system is set in lean mode by closing the fuel valve 26, corresponding to the box "Set/maintain lean mode" 109 of FIG. 2. Thus, the fourth start attempt "Pull 4" was executed in lean mode, hereby having the fuel valve 26 closed, and hence only start fuel 205 from the start fuel outlet 25 was delivered. During this start attempt, the engine ignited and started to run, corresponding to the box "Engine starts to run" 117 of FIG. 2. The control scheme now changes to a "Start gas control" scheme 201 (which is not described in details since it does not form a part of the present invention). The "Start gas control" 201 is active until the throttle trigger is actuated, and the "Start gas control" 201 is replaced by other control schemes, here named as "Normal control" 202, which handle different operating situations such as idling (as described in WO 2009/038503, for example) and full throttle (as described in WO 2007/133125, for example). During "Start gas control" 201 (see FIG. 1), the main amount of fuel 207 is drawn for the main and idling outlets 19-22 by opening and closing the fuel valve 26. However, since the choke valve 32 (See FIG. 1) is closed during "Start gas control", small amounts of fuel will also be drawn from the start fuel outlet 25. During "Normal control", the main amount of fuel 208 is drawn from the main or idling outlets 19-22 depending on if it is operating at full throttle or at idle throttle. Since the choke valve 32 is opened during these operating conditions, almost no fuel if any will be drawn from the start fuel outlet 25. When the engine is stopped as corresponding to the box "Engine stops" 118, the fuel supply system is set in lean mode by closing the fuel valve 26, corresponding to the box "Set lean mode" 119.

Figure 4:
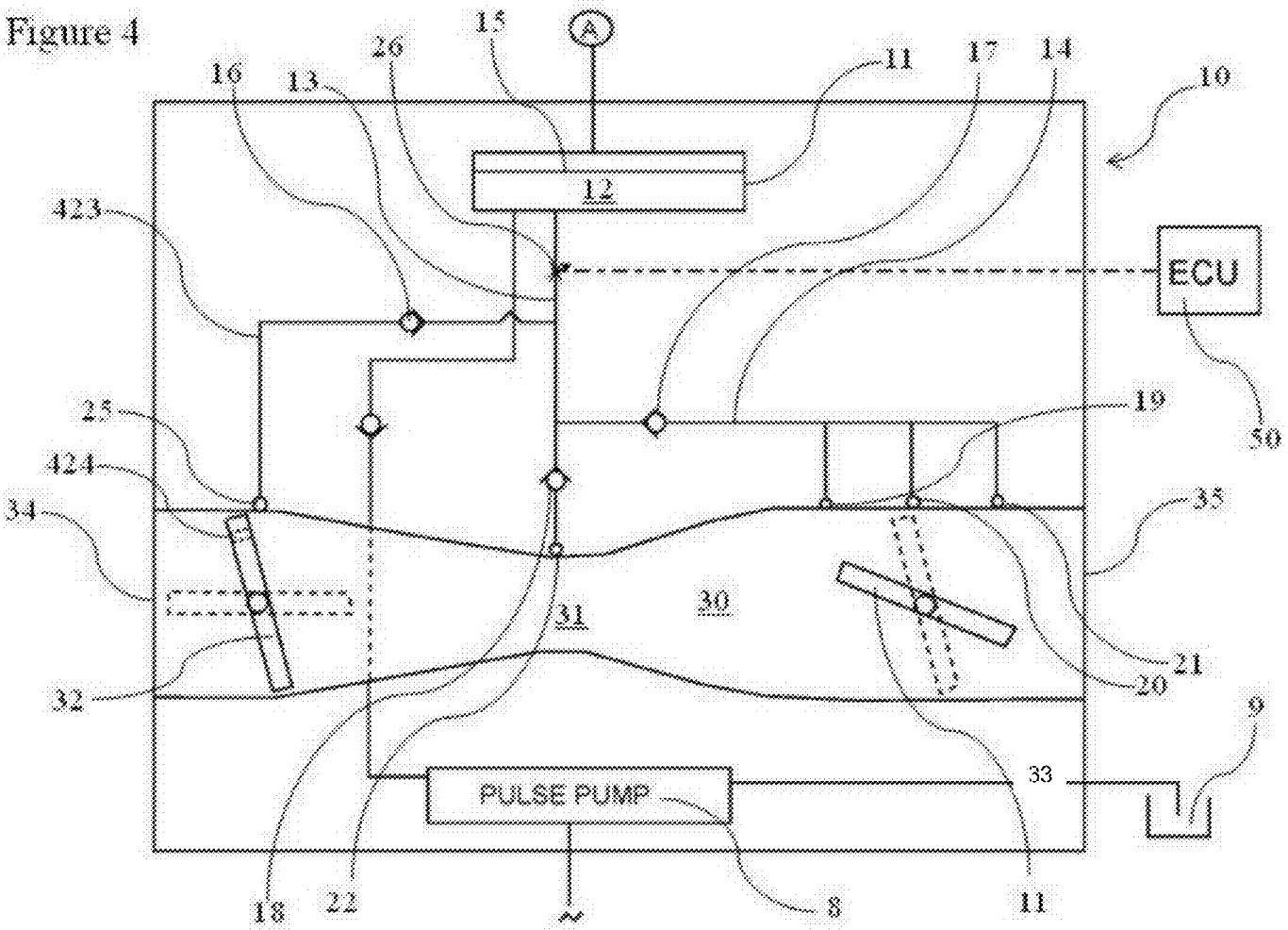
FIG. 4 is a schematic drawing of a second embodiment of a fuel supply system of a carburetor.

The fuel supply unit shown in FIG. 4 has so many features in common with that of FIG. 1 that the same reference numerals are used in both figures. However, where differences occur, the reference numerals are selected from the 400 series in FIG. 4. Thus, as an example, the start fuel line 23 in FIG. 1 is designated 423 in FIG. 4.

In FIG. 1, the start fuel line 23 drew fuel from the regulating chamber 11 and air from the air channel 24 to dilute the fuel concentration supplied from the start fuel outlet 25 to the intake channel 30 during operation of the engine. In contrast hereto, the start fuel line 423 in FIG. 4 is connected to the main fuel path 13 downstream of the actively controlled valve 26, so as to draw fuel from the main fuel path 13. Suitably, an area of the start fuel outlet 25 and an area of the main outlet 22 are of the same magnitude, and they may be of equal size, e.g. both of them may have a diameter of 0.9 mm.

Further, an air conduit 424, which permits a leakage of air past the choke valve 32, is substituted for the air channel 24, which in FIG. 1 connects ambient air to the start fuel line 23, so that it can draw fuel from the regulating chamber 11 to the intake channel 30 during operation of the engine. The air conduit 424 permits air to be drawn past the choke valve 32, thereby diluting the fuel concentration supplied from the start fuel outlet 25 to the intake channel 30 during operation of the engine. Usually, the choke valve is a butterfly valve having a valve disk 32 with a bore (not shown) in it of a diameter on the order of 4 mm to provide a desired leakage of air past the choke valve. Then, the air conduit 424 suitably is an additional bore of substantially the same size or a widening of the original bore to about double its original area. Of course, if desired, the air conduit 424 may be located wholly or partly in the periphery of the choke valve disk or the wall of the intake channel 30.

On pulling the start cord to start the engine, the fuel supply system of FIG. 1 keeps the actively controlled valve 26 open if the engine needs choking but closed if no choking is necessary. As contrasted hereto, in the fuel supply system of FIG. 4, the actively controlled valve 26 is always closed at the first pull in the start cord. Thereafter, the system opens the valve and makes it toggle between open and closed positions depending on factors like environmental temperature, number of pulls, detection of ignition that makes the engine try to increase its rpm, etc., but there is no memory indicating the time elapsed since the engine was running. The toggling movement of the actively controlled valve 26 results in a pulsating flow of fuel, but in a crankcase scavenged internal combustion engine, the mixture of air and fuel passes from the intake channel 30 to the crankcase before entering the combustion space, and over time concentration differences are equalized.

Whereas the invention has been shown and described in connection with the preferred embodiments thereof, it will be understood that many modifications, substitutions, and additions may be made, which are within the intended broad scope of the following claims. From the foregoing, it can be seen that the present invention accomplishes at least one of the stated objectives.

Alternatively, when shutting down the engine, the engine is set in lean or rich mode depending on one or more engine parameters. One example of conditions could be that if T1 is less than −5° C., then the engine at the first start attempt is started in rich mode and else in lean mode, i.e. expecting that the next start will be a cold start if T1 gives a low reading. Alternatively, even though it is not preferred, the engine could always be started in rich mode at the first start attempt.

The temperatures T1 and T2 can e.g. be measured by a temperature sensor mounted on a circuit board attached to the carburetor.

The invention claimed is:

1. A carburetor for an engine, said carburetor including:

an intake channel with a venturi section;

a throttle valve mounted in the intake channel, downstream of the venturi section;

a choke valve mounted in the intake channel, upstream of the venturi section; and a fuel supply system that is configured to be set in one of two modes during a start attempt of the engine, the two modes including a lean mode and a rich mode, the rich mode providing more fuel during the start attempt than the lean mode, the fuel supply system including:

a main fuel path connecting a diaphragm controlled regulating chamber to a main outlet in the region of the venturi section, the main fuel path including an electronically controlled fuel valve, an idling fuel path branching off from the main fuel path downstream of the electronically controlled fuel valve and ending in at least one idling outlet in the region of the throttle valve, and a start fuel line starting upstream or downstream of the electronically controlled fuel valve and ending in at least one start fuel outlet to the intake channel, wherein the electronically controlled fuel valve, which is located between the regulating chamber and the intake channel, is controlled by an engine control unit that is configured to determine, during the start attempt of the engine, whether to place the electronically controlled fuel valve in an open position to place the fuel supply system in the rich mode or a closed position to place the fuel supply system in the lean mode, wherein the engine control unit is configured to use sensor data to determine when to place the electronically controlled fuel valve in the open position or the closed position, wherein the sensor data includes data indicative of throttle position, a previous start attempt, engine speed, or engine temperature, and wherein if the sensor data indicates the previous start attempt, the engine control unit is configured to determine to place the electronically controlled fuel valve in the closed position.

2. A carburetor according to claim 1, wherein the start fuel line starts upstream of the electronically controlled fuel valve and the carburetor includes an air channel that connects ambient air to the start fuel line, so that the start fuel line is configured to draw fuel from the regulating chamber and air from the air channel, thereby diluting the fuel concentration supplied from the start fuel outlet to the intake channel during operation of the engine.

3. A carburetor according to claim 1, wherein the start fuel line starts downstream of the electronically controlled fuel valve and the carburetor includes an air conduit that permits a leakage of air past the choke valve, so that the start fuel line is configured to draw fuel from the main fuel path and air through the conduit past the choke valve, thereby diluting the fuel concentration supplied from the start fuel outlet to the intake channel during operation of the engine.

4. A carburetor according to claim 3, wherein the choke valve is a butterfly valve having a closing mechanism in form of a disk, and wherein the air conduit, which permits a leakage of air past the choke valve, is either an enlarged bore through the disk or an additional bore through the disk to increase the air flow through the choke valve when the electronically controlled fuel valve is closed.

5. A carburetor according to claim 1, wherein said at least one start fuel outlet is located upstream of the venturi section, in the region of the choke section and downstream of the choke valve, for supplying fuel to the intake channel.

6. A carburetor according to claim 1, wherein the at least one idling outlet includes a first, second, and third idling outlet, the first idling outlet being disposed upstream of the throttle valve, the second idling outlet disposed substantially above the throttle valve, and the third idling outlet disposed downstream of the throttle valve.

7. A carburetor according to claim 1, wherein the main fuel path, the idling fuel path, and the start fuel line each have a check valve for preventing fuel flowing back to a fuel metering chamber.

8. A carburetor according to claim 1, wherein when the electronically controlled fuel valve is in the open position, fuel is configured to be drawn from the main outlet and the at least one idling fuel outlet.

9. A carburetor according to claim 1, wherein when the electronically controlled fuel valve is in the closed position, fuel is configured to be drawn only from the start fuel outlet.

10. A carburetor according to claim 1, wherein during the start attempt of the engine, the throttle valve is configured to be slightly open.

11. A carburetor according to claim 1, wherein during the start attempt of the engine, the choke valve is configured to be closed.

12. A carburetor for an engine, said carburetor including:
an intake channel with a venturi section;
a throttle valve mounted in the intake channel, downstream of the venturi section;
a choke valve mounted in the intake channel, upstream of the venturi section; and
a fuel supply system that is configured to be set in one of two modes during a start attempt of the engine, the two modes including a lean mode and a rich mode, the rich mode providing more fuel during the start attempt than the lean mode, the fuel supply system including:
a main fuel path connecting a diaphragm controlled regulating chamber to a main outlet in the region of the venturi section, the main fuel path including an electronically controlled fuel valve,
an idling fuel path branching off from the main fuel path downstream of the electronically controlled fuel valve and ending in at least one idling outlet in the region of the throttle valve, and
a start fuel line starting upstream or downstream of the electronically controlled fuel valve and ending in at least one start fuel outlet to the intake channel, wherein the electronically controlled fuel valve, which is located between the regulating chamber and the intake channel, is controlled by an engine control unit that is configured to determine, during the start attempt of the engine, whether to place the electronically controlled fuel valve in an open position to place the fuel supply system in the rich mode or a closed position to place the fuel supply system in the lean mode,
wherein the engine control unit is configured to use sensor data to determine when to place the electronically controlled fuel valve in the open position or the closed position,
wherein the sensor data includes data indicative of throttle position, a previous start attempt, engine speed, or engine temperature, and
wherein if the sensor data indicates the engine is warm, the engine control unit is configured to determine to place the electronically controlled fuel valve in the closed position.

13. A carburetor according to claim 12, wherein the start fuel line starts upstream of the electronically controlled fuel valve and the carburetor includes an air channel that connects ambient air to the start fuel line, so that the start fuel line is configured to draw fuel from the regulating chamber and air from the air channel, thereby diluting the fuel concentration supplied from the start fuel outlet to the intake channel during operation of the engine.

14. A carburetor according to claim 12, wherein the start fuel line starts downstream of the electronically controlled fuel valve and the carburetor includes an air conduit that permits a leakage of air past the choke valve, so that the start fuel line is configured to draw fuel from the main fuel path and air through the conduit past the choke valve, thereby diluting the fuel concentration supplied from the start fuel outlet to the intake channel during operation of the engine.

15. A carburetor for an engine, said carburetor including:
an intake channel with a venturi section;
a throttle valve mounted in the intake channel, downstream of the venturi section;
a choke valve mounted in the intake channel, upstream of the venturi section; and
a fuel supply system that is configured to be set in one of two modes during a start attempt of the engine, the two modes including a lean mode and a rich mode, the rich mode providing more fuel during the start attempt than the lean mode, the fuel supply system including:
a main fuel path connecting a diaphragm controlled regulating chamber to a main outlet in the region of the venturi section, the main fuel path including an electronically controlled fuel valve,
an idling fuel path branching off from the main fuel path downstream of the electronically controlled fuel valve and ending in at least one idling outlet in the region of the throttle valve, and
a start fuel line starting upstream or downstream of the electronically controlled fuel valve and ending in at least one start fuel outlet to the intake channel, wherein the electronically controlled fuel valve, which is located between the regulating chamber and the intake channel, is controlled by an engine control unit that is configured to determine, during the start attempt of the engine, whether to place the electronically controlled fuel valve in an open position to place the fuel supply system in the rich mode or a closed position to place the fuel supply system in the lean mode,
wherein the engine control unit is configured to use sensor data to determine when to place the electronically controlled fuel valve in the open position or the closed position,
wherein the sensor data includes data indicative of throttle position, a previous start attempt, engine speed, or engine temperature, and
wherein if the sensor data indicates the engine is cold and there has been no previous engine ignition, the engine control unit is configured to determine to place the fuel valve in the open position.

16. A carburetor according to claim 15, wherein the start fuel line starts upstream of the electronically controlled fuel valve and the carburetor includes an air channel that connects ambient air to the start fuel line, so that the start fuel line is configured to draw fuel from the regulating chamber and air from the air channel, thereby diluting the fuel concentration supplied from the start fuel outlet to the intake channel during operation of the engine.

17. A carburetor according to claim 15, wherein the start fuel line starts downstream of the electronically controlled fuel valve and the carburetor includes an air conduit that permits a leakage of air past the choke valve, so that the start fuel line is configured to draw fuel from the main fuel path and air through the conduit past the choke valve, thereby diluting the fuel concentration supplied from the start fuel outlet to the intake channel during operation of the engine.

18. A carburetor for an engine, said carburetor including:
an intake channel with a venturi section;
a throttle valve mounted in the intake channel, downstream of the venturi section;
a choke valve mounted in the intake channel, upstream of the venturi section; and
a fuel supply system that is configured to be set in one of two modes during a start attempt of the engine, the two modes including a lean mode and a rich mode, the rich mode providing more fuel during the start attempt than the lean mode, the fuel supply system including:

a main fuel path connecting a diaphragm controlled regulating chamber to a main outlet in the region of the venturi section, the main fuel path including an electronically controlled fuel valve, an idling fuel path branching off from the main fuel path downstream of the electronically controlled fuel valve and ending in at least one idling outlet in the region of the throttle valve, and a start fuel line starting upstream or downstream of the electronically controlled fuel valve and ending in at least one start fuel outlet to the intake channel, wherein the electronically controlled fuel valve, which is located between the regulating chamber and the intake channel, is controlled by an engine control unit that is configured to determine, during the start attempt of the engine, whether to place the electronically controlled fuel valve in an open position to place the fuel supply system in the rich mode or a closed position to place the fuel supply system in the lean mode, wherein the engine control unit is configured to use sensor data to determine when to place the electronically controlled fuel valve in the open position or the closed position, wherein the sensor data includes data indicative of throttle position, a previous start attempt, engine speed, or engine temperature, and wherein if the sensor data indicates the engine is cold and there has been previous engine ignition, the engine control unit is configured to determine to place the fuel valve in the closed position.

19. A carburetor according to claim 18, wherein the start fuel line starts upstream of the electronically controlled fuel valve and the carburetor includes an air channel that connects ambient air to the start fuel line, so that the start fuel line is configured to draw fuel from the regulating chamber and air from the air channel, thereby diluting the fuel concentration supplied from the start fuel outlet to the intake channel during operation of the engine.

20. A carburetor according to claim 18, wherein the start fuel line starts downstream of the electronically controlled fuel valve and the carburetor includes an air conduit that permits a leakage of air past the choke valve, so that the start fuel line is configured to draw fuel from the main fuel path and air through the conduit past the choke valve, thereby diluting the fuel concentration supplied from the start fuel outlet to the intake channel during operation of the engine.

* * * * *